United States Patent [19]

Brämer et al.

[11] Patent Number: 4,934,664

[45] Date of Patent: Jun. 19, 1990

[54] MELTING TROUGH FOR MELTING METAL WITH SENSOR

[75] Inventors: Wulf Brämer, Bruchköbel; Udo Schusser, Alzenau; Heinz Schneider, Linsengericht; Hans Kreutzer, Gelnhausen, all of Fed. Rep. of Germany

[73] Assignee: Heraeus Edelmetalle GmbH, Hanau, Fed. Rep. of Germany

[21] Appl. No.: 393,580

[22] Filed: Aug. 14, 1989

[30] Foreign Application Priority Data

Nov. 9, 1988 [DE] Fed. Rep. of Germany ..... 3837960

[51] Int. Cl.[5] ..... F27D 3/10

[52] U.S. Cl. ..... 266/44; 266/88

[58] Field of Search ..... 266/78, 87, 88, 99, 266/44, 196, 231; 164/150, 154

[56] References Cited

U.S. PATENT DOCUMENTS 4,105,191 8/1978 Charbonnier ..... 266/88

FOREIGN PATENT DOCUMENTS 1054735 10/1959 Fed. Rep. of Germany .

1262521 7/1971 Fed. Rep. of Germany .

*Primary Examiner*—S. Kastler

*Attorney, Agent, or Firm*—Felfe & Lynch

[57] ABSTRACT

A melting trough made of ceramic material is used for melting small amounts of metal by means of a flame including at least one trough channel which is not closed during operation. A thermosensor having a protective cover extends into the trough which is filled with melt during operation through an aperture in the wall of the trough. The aperture as well as the thermosensor are located below the level of the melt.

8 Claims, 2 Drawing Sheets

MELTING TROUGH FOR MELTING METAL WITH SENSOR

Figures 1A, 1B, 1C, 1D, 1E, 1F:
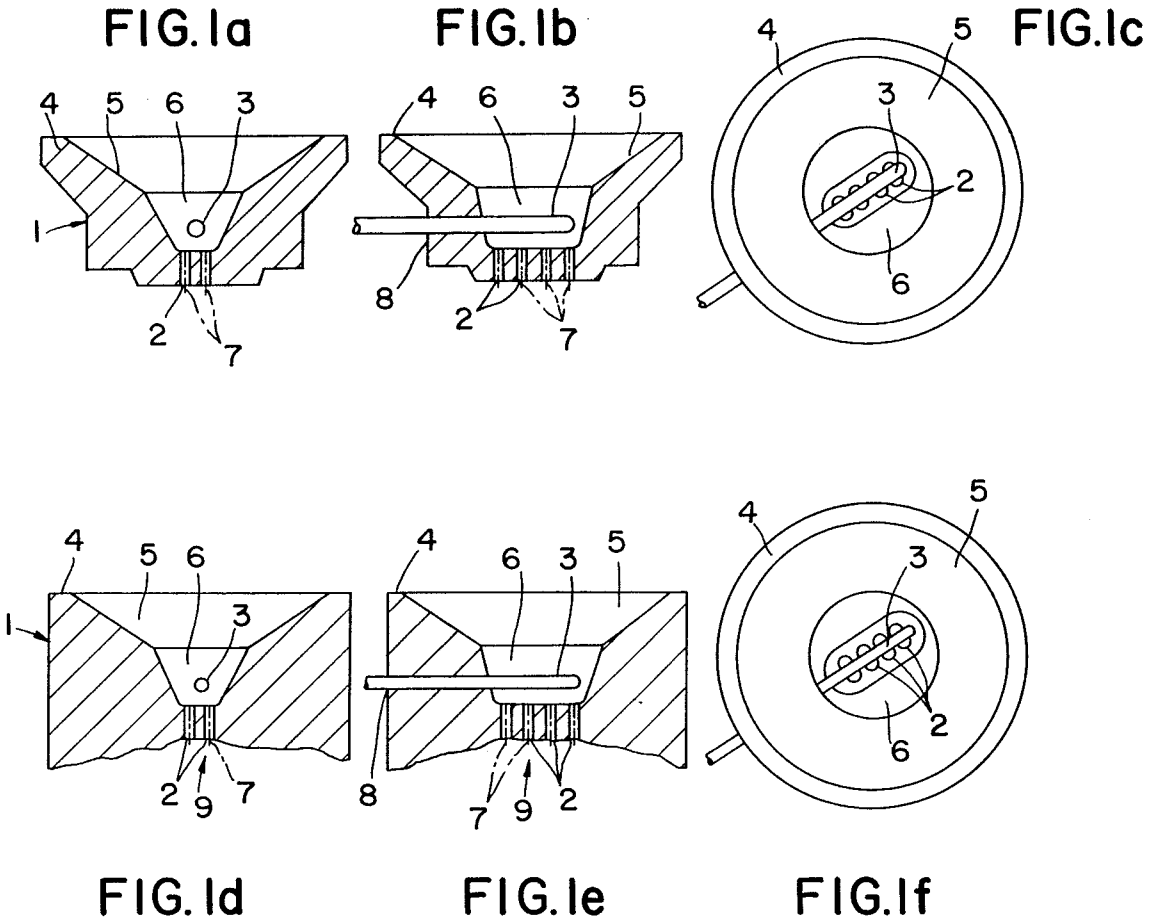

The invention relates to a melting trough for melting metal by means of a flame including a trough which is filled with melt during operation and including at least one trough channel which is not closed during the melting of the metal.

On one hand, the melting trough can be in a crucible which can be placed onto the casting mold; on the other hand, it is also possible to configure this trough in the casting mold itself by means of the embedding mass.

Further, it is also possible to use the melting trough in a centrifugal casting machine.

From the German DE-AS 1 054 735 it is known to rigidly include a temperature sensor equipped with a protective device in the wall of a melting vessel having a feeding channel which is completely below the level of the melt. For correct temperature measuring, the temperature sensor extends into the melt while enclosed by a protective collet with good thermal conductivity.

Furthermore, from the German DE-PS 1 262 521 a casting device is known for a system to melt and cast metals including a melting crucible having a bottom discharge aperture; the crucible opening is provided with a discharge between the crucible bottom and a casting form. The top section of the discharge is configured as an insert element in the form of an apertured plate or apertured crucible or provided with rotary walls and the bottom section has a cone-like configuration. For monitoring the melting process, a lateral wall is furnished with a temperature measuring device which, however, does not extend in to the melt. The melting is carried out under vacuum and the melting crucible, the discharge, and the supplementary mold are disposed in a vacuum chamber. The known devices involve a relatively high amount of cost and labor and are intended for larger amounts of melting material to be charged. Further, both devices are not suitable for melting smaller amounts of metal by means of a flame as required for the manufacture of jewelry and in dental technology.

It is an object the invention to create a melting trough for melting smaller amounts of metals by means of a flame ensuring that the measuring of the temperature of the melt be exact and without time lag. The melting trough must be designed such that even small amounts of melt completely surround the thermosensor on all sides so as to exactly determine the casting temperature of the respective melt. Moreover, any reaction or partial reaction between the melt and the material of the melting trough and the protective tube of the thermosensor must be avoided.

This object is achieved by apparatus in accordance with claim 1. Further advantageous embodiments of the invention are set forth in the subclaims.

Due to the surface tension, the capillary trough (pouring) channel prevents the molten material from passing through the trough channel during the melting process. The surface tension is finally surpassed by the pressure of the gas affecting the melt.

The use of pressed oxide ceramics proved to be particularly advantageous for the melting trough; no reaction between melting material and melting trough occurred during the heating by flame. The same applies to the thermosensor placed inside a ceramic protective tube. The melting trough and the thermosensor can consequently be repeatedly used while contamination from preceding melting processes must not be apprehended. Since the test prod of the thermosensor immerses into the melt, an exact determination of the melting temperature is possible. A thermoelement is preferably used as a thermosensor.

In accordance with the invention, a melting trough for melting metal by means of a flame including a trough which is filled with melt during operation comprises at least one trough channel which is not closed during the melting of the metal. The trough includes at least one trough wall having an aperture. The trough also includes a thermosensor having a protective cover and extending into the trough through the aperture in the one wall of the trough. The aperture and the thermosensor are located below the level of the melt to be molten.

For a better understanding of the invention, together with other and further objects thereof, reference is made to the following description, taken in connection with the accompanying drawings, and its scope will be pointed out in the appended claims.

Referring now to the drawings:

FIGS. 1*a* and 1*b* are side elevational views, in section perpendicular to one another, of a melting trough element for a die casting machine made of graphite or ceramics.

FIG. 1*c* is a top plan view of the melting trough element of FIGS. 1*a* and 1*b*. The melt enters the trough channel in vertical direction according to gravitational force.

FIGS. 1*d*, 1*e*, 1*f f* represent in corresponding side elevational views in section and in a top plan view a melting trough formed by the embedding mass in the casting mold. The protective tube provided for introducing the temperature sensor is fixed in its correct position by the embedding mass.

Figure 2B:
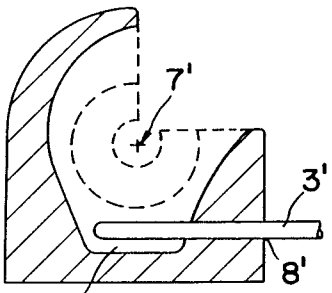
Figure 2A:
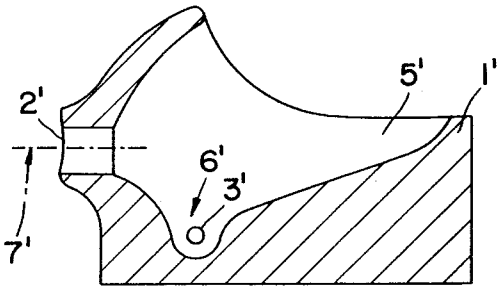
Figure 2C:
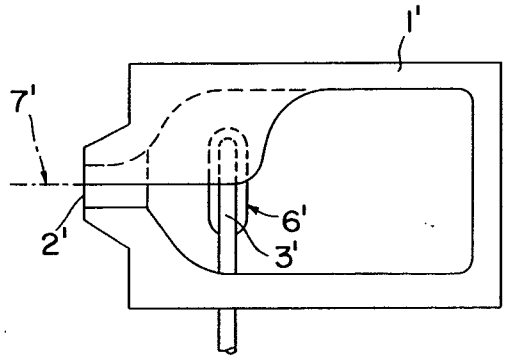

FIGS. 2*a*, 2*b*, 2*c* represent in side elevational views in section and in a top plan view a melting trough for a centrifugal melting device having a trough channel which is placed above the level of the melting mass to be charged. The melt enters the trough channel due to centrifugal force.

Referring to FIG. 1*a*, the melting trough is configured such that the protective tube 3 which extends through an aperture 8 in the wall of the trough is disposed directly above the apertures of the capillary trough channels 2. It is thus possible to exactly measure the temperature of the material to be molten without time lag. The maximum distance from the temperature sensor 3 to the trough channel 2 and to the inside wall of the cone-like configured melting trough preferably is 2 mm. The trough channel 2 is vertically aligned such that the gravitational force can take effect in addition to the pressurized gas atmosphere. For optimal solidification of the casting objects it is essential that the capillary trough channels have a longitudinal extension between 1 and 20 mm. The diameter of the capillaries which depends on the surface tension is variable; preferably, it is between 0.5 and 1.5 mm. The trough channel can be configured as boreholes or in the form of inserted capillary tubes. Below the capillary trough channels, a pipe-like mold channel extends or, depending on the size of the melting object several pipe-like mold channels extend. Each mold channel is connected to at least two capillary trough channels. The mold channels are part of the actual casting mold which in the practice is configured as a so-called "dead mold." The outlet directions of the trough channels 2 are symbolically indicated by the axes 7. As can be seen from FIG. 1*a*, the interior cross section of the interior hollow space of the melting trough is almost cone-like, whereas the cross section along the passages of the trough channels 2 according to FIG. 1*b* has a prism-like interior space or an interior space with a complex cross section. In the practice, a spherical cross section often proved to be particularly advantageous. The top view according to FIG. 1*c* represents in addition to the externally surrounding edge 4 the feeding aperture 5 configured as a truncated cone as well as the melting space which is configured as trough recess 6. The protective tube 3 extends over all apertures of the trough channels 2. The protective tube 3 can be movably disposed inside the aperture 8 of the trough wall such that the thermosensor can be removed after completion of the casting process together with the protective cover.

The device represented in FIGS. 1*d*, 1*e* corresponds in its principal method of operation to the embodiment as explained based on the FIGS. 1*a*, 1*b*, 1*c*; however, the melting trough 1 together with the capillary trough channels belongs to the embedding mass of the casting mold, i.e. the presently bipartite embodiment is now replaced by a one-piece casting mold which can also be configured as a so-called "dead mold." As represented in the two longitudinal cross sections in FIGS. 1*d* and 1*e*, a mold channel 9, which belongs to the actual casting mold, is connected to the capillary trough channels 2

The protective tube 3 is rigidly attached in the aperture 8 while the actual thermosensor can be inserted and removed again after completion of the casting process.

The top plan view of FIG. 1*f* corresponds to the bipartite mold as illustrated in FIG. 1*c*.

FIG. 2*a* represents a melting trough 1' for a centrifugal casting device. The trough channel 2' is disposed above the interior melting space configured as a trough and the thermosensor 3'. The feeding aperture has the reference numeral 5'. In this case, too, the melting is performed by using an open flame. After reaching the casting temperature determined by thermosensor 3', the melting trough, which is disposed on a drive device, is set into rotation and the molten material is supplied to the casting mold which is connected thereto through the trough channel by means of centrifugal force. FIG. 2*a* is a side elevational view, in cross section, of the melting trough in accordance with the invention, whereas FIG. 2*b* is a front view of the melting trough in cross section. FIG. 2*c* is a top plan view of the trough-like interior as well as of the cone-like shaped trough channel 2'. Above the recess 6', there is the thermosensor 3' enclosed by the protective tube. The molten material exits through the trough (pouring) channel practically in radial direction along the axis 7'. The actual casting mold, which is, for example, configured as a dead mold, is connected to the trough channel 2' in the direction of the axis 7'.

The use of pressed ceramics proved to be particularly advantageous, in particular the use of alum earth having a high percentage of aluminum oxide as a ceramic material for the melting trough. Since there is no residual matter left, the melting trough can be repeatedly used without contamination, provided the melting trough is not part of a dead mold according to FIGS. 1*d* to 1*f*. Pressed aluminum oxide ceramics also proved to be good as a material for the protective tube for the thermosensor. However, it is also possible to use other materials such as graphite, for example.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A melting trough for melting metal by means of a flame including a trough which is filled with melt during operation, comprising:

a bottom portion of the trough and a recess in said bottom portion;

at least one pouring channel in said bottom portion and which is open during the melting of the metal;

at least one lateral trough wall having an aperture;

a thermosensor having a protective cover and extending essentially horizontally into said recess of the trough through said aperture in said lateral wall; and said aperture and said thermosensor being located below the lever of the molten metal.

2. A melting trough in accordance with claim 1, in which said at least one trough channel is located below the level of the molten metal while the molten metal is maintained in the trough by capillary effects which includes at least one capillary trough channel as the pouring channel.

3. A melting trough in accordance with claim 1, which includes at least two pouring channels which lead to one mold channel of a casting mold.

4. A melting trough in accordance with claim 3, in which the melting trough is placed upon the casting mold.

5. A melting trough in accordance with claim 3, in which the melting trough is configured as a part of the casting mold by means of an embedding mass.

6. A melting trough in accordance with claim 1, which has a trough channel having an upper portion located above the level of the molten metal.

7. A melting trough in accordance with claim 6, as a portion of a centrifugal melting device and in which the molten metal is fed to said trough channel by means of centrifugal force.

8. A method of melting metal by means of a flame comprising:

charging with metal a trough having at least one pouring channel which is open during the melting of the metal, the trough having a bottom portion and a recess in said bottom portion, at least one trough wall having an aperture, the trough having a thermosensor having a protective cover and extending essentially horizontally into said recess of the trough through said aperture in said lateral wall; and bringing the level of the molten metal during operation above the aperture and the thermosensor.

* * * * *